US010615491B2

(12) United States Patent
Cohen

(10) Patent No.: US 10,615,491 B2
(45) Date of Patent: Apr. 7, 2020

(54) ANTENNA FOR APPENDAGE-WORN MINIATURE COMMUNICATIONS DEVICE

(71) Applicant: Fractal Antenna Systems, Inc., Bedford, MA (US)

(72) Inventor: Nathan Cohen, Belmont, MA (US)

(73) Assignee: Fractal Antenna Systems, Inc., Bedford, MA (US)

( * ) Notice: Subject to any disclaimer, the term of this patent is extended or adjusted under 35 U.S.C. 154(b) by 0 days.

(21) Appl. No.: 16/214,708

(22) Filed: Dec. 10, 2018

(65) Prior Publication Data

US 2019/0109368 A1 Apr. 11, 2019

Related U.S. Application Data

(63) Continuation of application No. 15/221,219, filed on Jul. 27, 2016, now Pat. No. 10,153,540.

(60) Provisional application No. 62/197,376, filed on Jul. 27, 2015.

(51) Int. Cl.

| | |
|---|---|
| ***H01Q 1/27*** | (2006.01) |
| ***H01Q 9/40*** | (2006.01) |
| *H01Q 1/24* | (2006.01) |

(52) U.S. Cl.

CPC ..... *H01Q 1/273* (2013.01); *H01Q 9/40* (2013.01); *H01Q 1/241* (2013.01)

(58) Field of Classification Search

CPC ..... H01Q 1/241; H01Q 1/273; H01Q 9/40; H01Q 1/27

See application file for complete search history.

(56) References Cited

U.S. PATENT DOCUMENTS

| | | | |
|---|---|---|---|
| 6,104,349 | A | 8/2000 | Cohen |
| 6,127,977 | A | 10/2000 | Cohen |
| 6,140,975 | A | 10/2000 | Cohen |
| 6,445,352 | B1 | 9/2002 | Cohen |
| 6,452,553 | B1 | 9/2002 | Cohen |
| 6,476,766 | B1 | 11/2002 | Cohen |

(Continued)

FOREIGN PATENT DOCUMENTS

| | | |
|---|---|---|
| EP | 1 326 302 | 7/2003 |
| JP | 2005102959 | 4/2005 |
| JP | 2014007743 | 1/2014 |

OTHER PUBLICATIONS

International Search Report and Written Opinion issued in corresponding PCT Application PCT/US2016/044284 dated Oct. 31, 2016 (11 pgs).

(Continued)

*Primary Examiner* — Tho G Phan

(74) *Attorney, Agent, or Firm* — Cesari and McKenna, LLP

(57) ABSTRACT

Antennas, antenna systems, and communications devices are described that provide an antenna utilizing a fractal and/or self-similar conductive element that is novel and inventive in that its small in size and exhibits multiple-band or wideband frequency coverage which allows a miniature communications device incorporating the antenna to operate (e.g., function) with wide-band capabilities in close-proximity to a user's body and in form factor suitable for wearing by the user. As noted above, previous size and performance limitations of prior art antennas/devices were poor and made those devices either of limited utility or inoperable.

6 Claims, 3 Drawing Sheets

(56) References Cited

U.S. PATENT DOCUMENTS

| | | | | |
|---|---|---|---|---|
| 6,710,744 | B2 * | 3/2004 | Morris | H01Q 1/273 343/700 MS |
| 6,985,122 | B2 | 1/2006 | Cohen | |
| 7,019,695 | B2 | 3/2006 | Cohen | |
| 7,126,537 | B2 | 10/2006 | Cohen | |
| 7,145,513 | B1 | 12/2006 | Cohen | |
| 7,190,318 | B2 | 3/2007 | Cohen | |
| 7,215,290 | B2 | 5/2007 | Cohen | |
| 7,256,751 | B2 | 8/2007 | Cohen | |
| 7,345,642 | B2 | 3/2008 | Cohen | |
| 7,456,799 | B1 | 11/2008 | Cohen | |
| 8,674,810 | B2 * | 3/2014 | Uysal | G06K 7/0008 340/10.4 |
| 8,878,735 | B2 * | 11/2014 | Kvist | H01Q 13/10 343/718 |
| 8,988,296 | B2 * | 3/2015 | Koskiniemi | G01S 19/14 343/702 |
| 2002/0000940 | A1 | 1/2002 | Moren | |
| 2002/0098807 | A1 | 7/2002 | Saamimo | |
| 2011/0019830 | A1 | 1/2011 | Leibman et al. | |
| 2012/0069716 | A1 | 3/2012 | Peng | |
| 2013/0265199 | A1 | 10/2013 | Kskiniemi | |
| 2013/0342407 | A1 | 12/2013 | Kvist | |
| 2015/0188217 | A1 | 7/2015 | Tsai | |
| 2017/0115511 | A1 * | 4/2017 | Beaton | G02C 7/04 |

OTHER PUBLICATIONS

International Preliminary Report on Patentability issued in corresponding PCT Application PCT/US2016/044284 dated Feb. 8, 2018 (8 pgs).

Extended European Search Report issued in corresponding European Application No. 16831298.1 dated Feb. 19, 2019 (9 pgs).

* cited by examiner

ANTENNA FOR APPENDAGE-WORN MINIATURE COMMUNICATIONS DEVICE

CROSS-REFERENCE TO RELATED APPLICATION

This application is a continuation of U.S. application Ser. No. 15/221,219 entitled "Antenna for Appendage-Worn Miniature Communications Device, filed 27 Jul. 2016, which claims the benefit of U.S. provisional patent application 62/197,376, filed 27 Jul. 2015, entitled "Antenna for Miniature Appendage-Worn Miniature Communications Device," the entire content of both of which applications is incorporated herein by reference.

BACKGROUND

A recent trend in wireless communications is to move away from handheld devices exclusively to wireless devices that are wearable, that is, either part of or attached to garments, or worn as an appendage on the body such as with watches, bracelets, anklets, necklaces, earrings, and so on.

The challenge in these new wearable wireless devices is twofold. Firstly, their proximity to the body requires antennas that are wideband and or not sensitive to the tuning to accomplish the wireless communications. Secondly, these wearable devices must have antennas that are very small physically, yet are wideband or work over multiple bands over a wide frequency spectrum. The problem becomes acute, when considering the wavelengths used by these wireless devices, which typically range from roughly 40 cm to 5 cm, while the devices themselves, in contrast, are dramatically small compared to wavelength. Thus the antennas are very electrically small, and have difficulty operating over a wideband or multiple bands over a wide spectrum. Further, such prior art antennas have not been able to perform well in an environment where there is substantial near-field interaction with the associated RF electronics and also the user's body.

Prior art is manifested by a variety of notched antenna structures resembling inverted-F antennas or dipoles. While these antennas tend to work well on portable devices such as handsets, they are roughly a factor of 30-50% too big to fit within miniature communications devices or be a small part of an attachment to an appendage, e.g., a watch, pendant, necklace, small portion of a worn garment, and the like. The prior art may attempt to solve this by having small, individual antennas that operate at Wi-Fi or Bluetooth frequency bands, for example, but do not encompass a wide enough swath of frequency bands such as seen with modern cell phone enabled devices. Furthermore, diversity needs are not met by limited number of band antennas nor larger portable band antennas.

There is a need then for an antenna that is attached to one or more body appendage(s) or is part of a miniature communications device(s) attached to an appendage(s).

SUMMARY

Embodiments of the present disclosure provide an antenna utilizing a fractal and/or self-similar conductive element that is novel and inventive in that its small in size and exhibits multiple-band or wideband frequency coverage which allows a miniature communications device incorporating the antenna to operate (e.g., function) with wide-band capabilities in close-proximity to a user's body and in form factor suitable for wearing by the user. As noted above, previous size and performance limitations of prior art antennas/devices were poor and made those devices either of limited utility or inoperable.

By utilizing a fractal or self-similar element, such antennas have a much smaller size than would otherwise be possible for the same electrical size. By employing a miniature fractal or self-similar element, the antennas offer greater electrical separation in the nearfield from the related electronic circuitry, e.g., of the coupled transceiver. The fractal or self-similar antenna element further provides for less coupling between the antenna and the RF electronics and also between the antenna and the user's body. Concomitantly, the greater electrical separation between the antenna (antenna element) and the RF electronics allows for the use of or reliance on a smaller dielectric value, which decreases the loss in the antenna, which in turn increases the efficiency and battery-life (all things being equal) of the related transceiver.

These, as well as other components, steps, features, objects, benefits, and advantages, will now become clear from a review of the following detailed description of illustrative embodiments, the accompanying drawings, and the claims.

BRIEF DESCRIPTION OF DRAWINGS

The drawings are of illustrative embodiments. They do not illustrate all embodiments. Other embodiments may be used in addition or instead. Details that may be apparent or unnecessary may be omitted to save space or for more effective illustration. Some embodiments may be practiced with additional components or steps and/or without all of the components or steps that are illustrated. When the same numeral appears in different drawings, it refers to the same or like components or steps.

DETAILED DESCRIPTION OF ILLUSTRATIVE EMBODIMENTS

Illustrative embodiments are now described. Other embodiments may be used in addition or instead. Details that may be apparent or unnecessary may be omitted to save space or for a more effective presentation. Some embodiments may be practiced with additional components or steps and/or without all of the components or steps that are described.

Embodiments of the present disclosure provide an antenna utilizing a fractal and/or self-similar conductive element that is novel and inventive in that its small in size and exhibits multiple-band or wideband frequency coverage which allows a miniature communications device incorporating the antenna to operate (e.g., function) with wide-band capabilities in close-proximity to a user's body and in form factor suitable for wearing by the user. As noted above, previous size and performance limitations of prior art antennas/devices were poor and made those devices either of limited utility or inoperable.

By utilizing a fractal or self-similar element, such antennas have a much smaller size than would otherwise be possible for the same electrical size. By employing a miniature fractal or self-similar element, the antennas offer greater electrical separation in the nearfield from the related electronic circuitry, e.g., of the coupled transceiver. The fractal or self-similar antenna element further provides for less coupling between the antenna and the RF electronics and also between the antenna and the user's body. Concomitantly, the greater electrical separation between the antenna (antenna element) and the RF electronics allows for the use of or reliance on a smaller dielectric value (e.g., such as afforded by air), which decreases the loss in the antenna, which in turn increases the efficiency and battery-life (all things being equal) of the related transceiver.

Figure 1A:
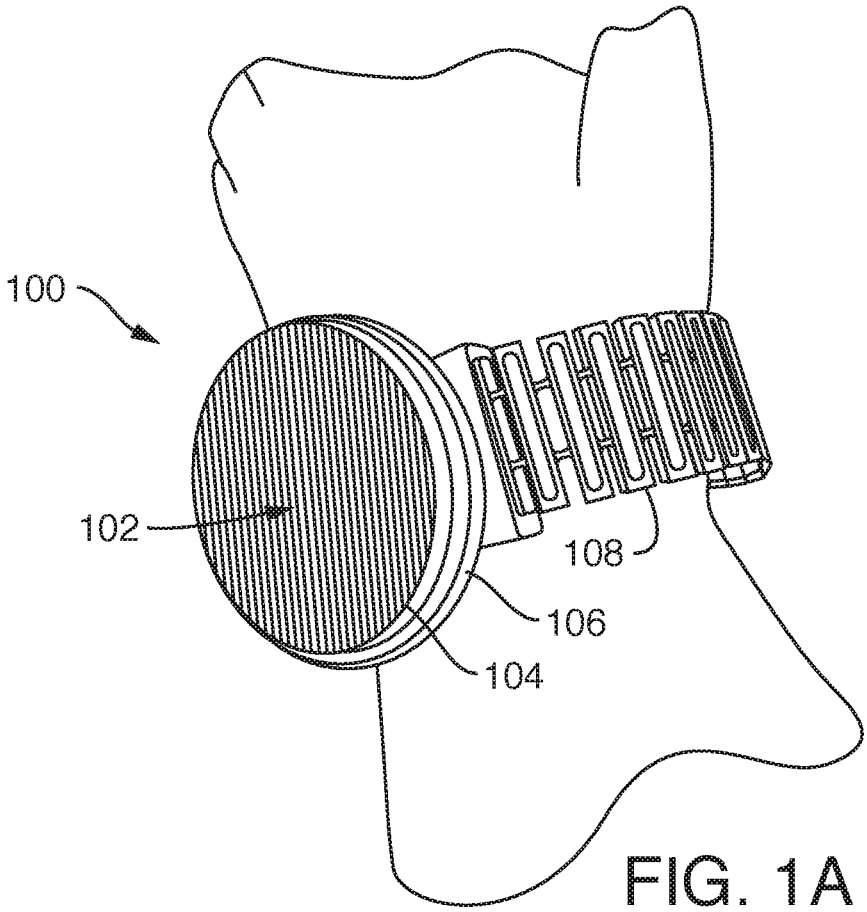
FIGS. 1A and 1B include two views, respectively, of photographs or photograph-derived drawings of an implemented embodiment of a communications device according to the subject technology of the present disclosure, as implemented with operational antenna within a wrist watch.
Figure 1B:
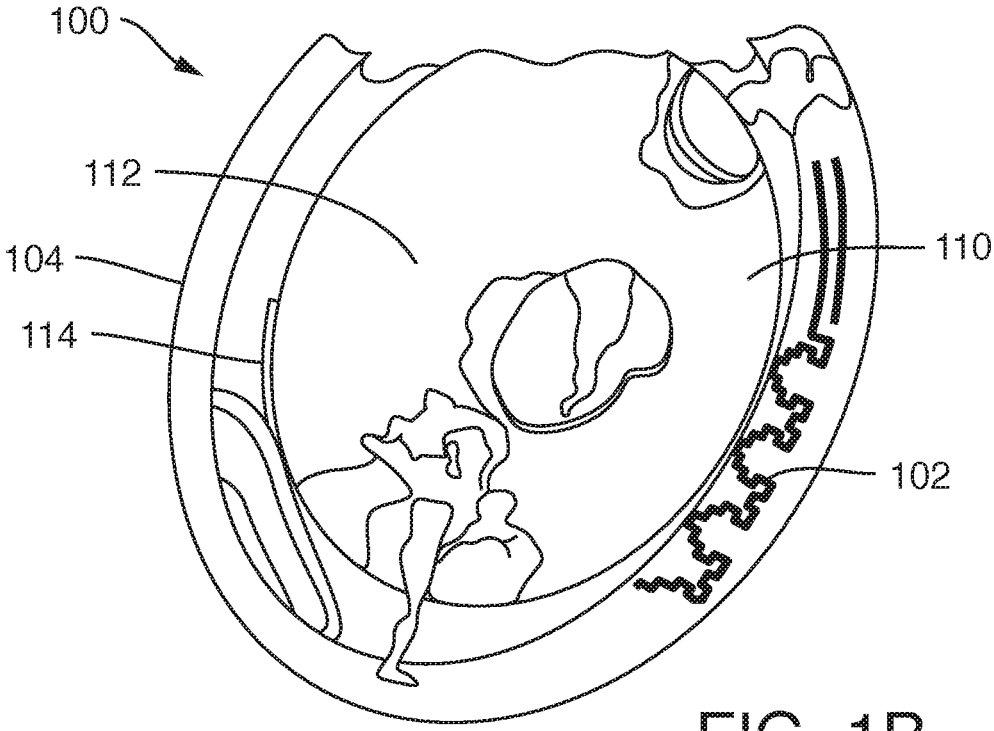

FIG. 1 includes two views (A)-(B), respectively, of photographs or photograph-derived drawings of an implemented embodiment of a communications device 100 according to the subject technology of the present disclosure, as implemented with operational antenna within a wrist watch. View (A) shows device 100 including an antenna or antenna conductive element (indicated by 102) within a housing having a first part 104 (upper portion) and a second part 106 (lower portion), held to a user's wrist by a band 108.

With continued reference to FIG. 1, view (B) shows a perspective looking at the first part 104 removed from the second part 106, with antenna element 102 visible. As shown, antenna element 102 may have a rectangular generator motif, e.g., of second or third order. Circuit board 110 is shown, which may include RF transceiver electronics/circuitry (not shown) that is operative to synthesize (modulate), transmit, receive, and demodulate RF signals in digital and/or analog format according wireless standards or technical specifications, also referred to as air interface standards or signaling protocols; examples include but are not limited to LTE (4G), 5G, Wi-Fi, Bluetooth, any and all of the IEEE 802.11 versions, UMTS, as well as the Global Positioning System (GPS), 2G and/or 3G standards such as IS-95, IS-54, GSM, IMT-2000, and other bands. Backplane 112 may also be included, as shown. A connection 114 is shown linking the circuit board 110 to the antenna element 102. A suitable power source (not shown) such as a lithium battery or batteries is used to supply power to the antenna and circuit board 110.

Examples of suitable fractal shapes for use in or for an antenna or antenna element according to the present disclosure can include, but are not limited to, any of the fractal shapes described in one or more of the following patents, owned by the assignee of the present disclosure, the entire contents of all of which are incorporated herein by reference: U.S. Pat. Nos. 6,452,553; 6,104,349; 6,140,975; 7,145,513; 7,256,751; 6,127,977; 6,476,766; 7,019,695; 7,215,290; 6,445,352; 7,126,537; 7,190,318; 6,985,122; 7,345,642; and, 7,456,799.

Other suitable fractal shapes for the antenna element structures can include any of the following: a Koch fractal, a Minkowski fractal, a Cantor fractal, a torn square fractal, a Mandelbrot, a Caley tree fractal, a monkey's swing fractal, a Sierpinski gasket, and a Julia fractal, a contour set fractal, a Sierpinski triangle fractal, a Menger sponge fractal, a dragon curve fractal, a space-filling curve fractal, a Koch curve fractal, an Lypanov fractal, and a Kleinian group fractal.

Figure 2:
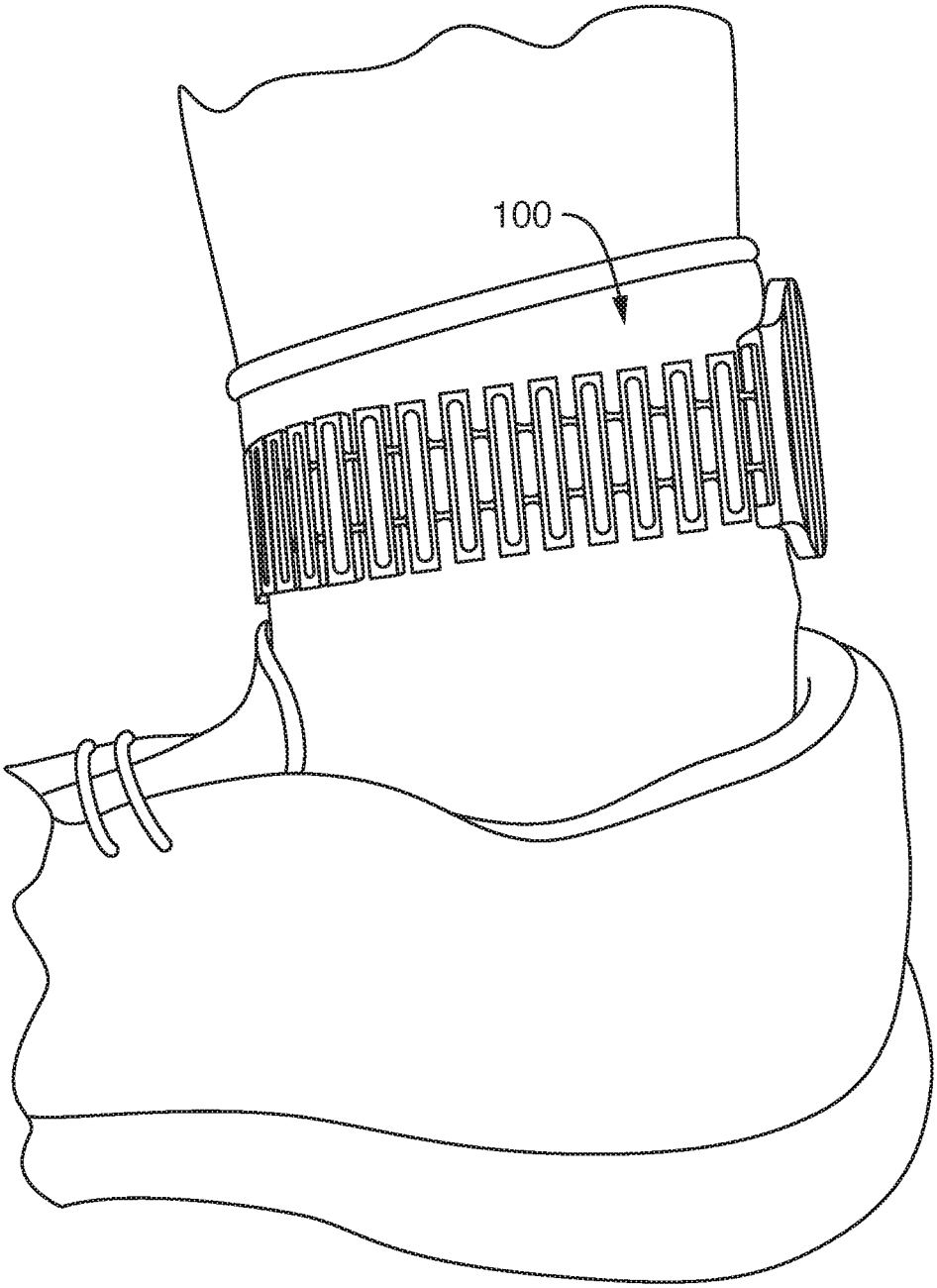
FIG. 2 is a photograph of the embodiment of FIG. 1 shown from a different perspective.

As noted previously, examples of the subject technology can be used for antennas used for transceivers worn on various areas of a user's body. FIG. 2 is a photograph or photograph-derived drawing of the embodiment 100 of FIG. 1 shown from a different perspective. In FIG. 2, the device 100 is shown worn on a user's ankle.

Figure 3:
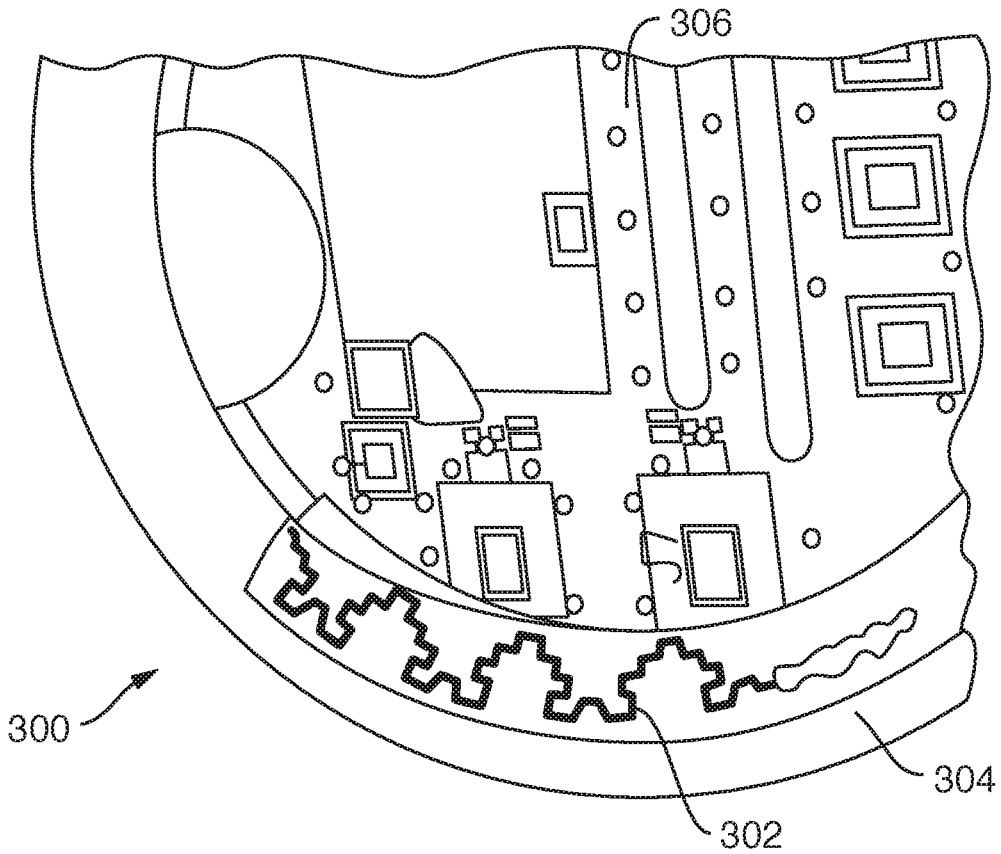
FIG. 3 is a photograph or photograph-derived drawings showing the interior of a further embodiment.

FIG. 3 is a photograph or photograph-derived drawing showing the interior of a further embodiment 300 of an antenna and communications device according to the subject technology. In the figure, a fractal or self-similar conductive antenna element 302 is shown affixed to the inside of a housing portion 304. The housing portion 304 may be part of a wearable communications device, e.g., a smart watch, or the like. Also shown is a printed circuit board 306 with processors and memory; circuit board 306 and its electronics/circuitry is operative to synthesize (modulate), transmit, receive and demodulate (desynthesize) RF signals in digital and/or analog format according wireless standards or technical specifications, also referred to as air interface standards or signaling protocols; examples include but are not limited to LTE (4G), 5G, Wi-Fi, Bluetooth, any and all of the IEEE 802.11 versions, UMTS, as well as the Global Positioning System (GPS), 2G and/or 3G standard such as IS-95, IS-54, GSM, IMT-2000, and other bands. A suitable power source (not shown) such as a lithium battery or batteries is used to supply power to the device, e.g., for the antenna and circuit board 110.

Embodiments of the present disclosure, and the invention described herein, can use fractal designs to miniaturize one or more antenna portions and thus enable miniature communications devices capable of working at a large number of frequency bands. Examples of such frequency bands include, but are not limited to those specified by well-known wireless standards or technical specifications, also referred to as air interface standards or signaling protocols, such as LTE (4G), 5G, Wi-Fi, Bluetooth, any and all of the IEEE 802.11 versions, UMTS, as well as the Global Positioning System (GPS), and other bands. The invention encompasses a method to design and make the antennas, these antennas, and the miniature communication devices that use them, which include, but are not limited to, pendants, badges, bandages, watches, and other appendage-attached devices, such as on the neck, arm, leg, ear, fingers, toes, foot, ankle, and for other animals, their relevant appendages, e.g., tail, snout, trunk, and the like.

Exemplary embodiments include an antenna including a conductive element, at least a portion of which is described by a fractal or self-similar geometry including two or more scalings (scaled versions), rotations, and or offsets of a generator motif structure; with the antenna element being housed in or included on a housing adapted to be worn attached to a body appendage. Exemplary embodiments may use air as a dielectric for the antenna.

Further exemplary embodiments include an antenna including a conductive element at least a portion of which is described by a fractal or self-similar geometry including two or more scalings (scaled versions), rotations, and or offsets of a generator motif structure; the antenna is attached to a miniature communications device, e.g., a RF transceiver, that is worn directly attached or in tactile proximity to a body appendage.

The noted antennas may operate at multiple frequency bands, e.g., within the 800 MHz-3600 MHz frequency range, or 800 MHz-6000 MHz frequency range.

The shapes of the antenna elements and/or related circuitry, and/or operation of communications devices that has been discussed herein can be implemented or designed with a specially-configured computer system specifically configured to perform the functions that have been described herein for the component. Each computer system includes one or more processors, tangible memories (e.g., random access memories (RAMs), read-only memories (ROMs), and/or programmable read only memories (PROMS)), tangible storage devices (e.g., hard disk drives, CD/DVD drives, and/or flash memories), system buses, video processing components, network communication components, input/output ports, and/or user interface devices (e.g., keyboards, pointing devices, displays, microphones, sound reproduction systems, and/or touch screens).

Each computer system may be a desktop computer or a portable computer, such as a laptop computer, a notebook computer, a tablet computer, a PDA, a smartphone, or part of a larger system, such a vehicle, appliance, and/or telephone system.

Each computer system may include one or more computers at the same or different locations. When at different locations, the computers may be configured to communicate with one another through a wired and/or wireless network communication system.

Each computer system may include software (e.g., one or more operating systems, device drivers, application programs, and/or communication programs). When software is included, the software includes programming instructions and may include associated data and libraries. When included, the programming instructions are configured to implement one or more algorithms that implement one or more of the functions of the computer system, as recited herein. The description of each function that is performed by each computer system also constitutes a description of the algorithm(s) that performs that function.

The software may be stored on or in one or more non-transitory, tangible storage devices, such as one or more hard disk drives, CDs, DVDs, and/or flash memories. The software may be in source code and/or object code format. Associated data may be stored in any type of volatile and/or non-volatile memory. The software may be loaded into a non-transitory memory and executed by one or more processors.

The components, steps, features, objects, benefits, and advantages that have been discussed are merely illustrative. None of them, or the discussions relating to them, are intended to limit the scope of protection in any way. Numerous other embodiments are also contemplated. These include embodiments that have fewer, additional, and/or different components, steps, features, objects, benefits, and/or advantages. These also include embodiments in which the components and/or steps are arranged and/or ordered differently.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

All articles, patents, patent applications, and other publications that have been cited in this disclosure are incorporated herein by reference.

The phrase "means for" when used in a claim is intended to and should be interpreted to embrace the corresponding structures and materials that have been described and their equivalents. Similarly, the phrase "step for" when used in a claim is intended to and should be interpreted to embrace the corresponding acts that have been described and their equivalents. The absence of these phrases from a claim means that the claim is not intended to and should not be interpreted to be limited to these corresponding structures, materials, or acts, or to their equivalents.

The scope of protection is limited solely by the claims that now follow. That scope is intended and should be interpreted to be as broad as is consistent with the ordinary meaning of the language that is used in the claims when interpreted in light of this specification and the prosecution history that follows, except where specific meanings have been set forth, and to encompass all structural and functional equivalents.

Relational terms such as "first" and "second" and the like may be used solely to distinguish one entity or action from another, without necessarily requiring or implying any actual relationship or order between them. The terms "comprises," "comprising," and any other variation thereof when used in connection with a list of elements in the specification or claims are intended to indicate that the list is not exclusive and that other elements may be included. Similarly, an element proceeded by an "a" or an "an" does not, without further constraints, preclude the existence of additional elements of the identical type.

None of the claims are intended to embrace subject matter that fails to satisfy the requirement of Sections 101, 102, or 103 of the Patent Act, nor should they be interpreted in such a way. Any unintended coverage of such subject matter is hereby disclaimed. Except as just stated in this paragraph, nothing that has been stated or illustrated is intended or should be interpreted to cause a dedication of any component, step, feature, object, benefit, advantage, or equivalent to the public, regardless of whether it is or is not recited in the claims.

The abstract is provided to help the reader quickly ascertain the nature of the technical disclosure. It is submitted with the understanding that it will not be used to interpret or limit the scope or meaning of the claims. In addition, various features in the foregoing detailed description are grouped together in various embodiments to streamline the disclosure. This method of disclosure should not be interpreted as requiring claimed embodiments to require more features than are expressly recited in each claim. Rather, as the following claims reflect, inventive subject matter lies in less than all features of a single disclosed embodiment. Thus, the following claims are hereby incorporated into the detailed description, with each claim standing on its own as separately claimed subject matter.

What is claimed is:

1. An antenna system comprising:

an antenna element, at least a portion of which is described by a fractal or self-similar geometry including two or more scalings, rotations, or offsets of a generator motif structure, wherein the antenna element is conductive; and a housing that holds the antenna element and is adapted to be worn attached to a body appendage;

wherein the antenna system is operative at one or more frequency bands utilized in LTE (4G), 5G, Wi-fi, Bluetooth, 2G, 3G, UMTS, or GPS; and wherein the antenna element is disposed on an inside surface of the housing.

2. The antenna system of claim 1, wherein the system is operative when the body appendage is in the nearfield of the antenna element.

3. A miniature RF communications device comprising:

an antenna element at least a portion of which is described by a geometry including two or more scalings, rotations, or offsets of a generator motif structure, wherein the antenna element is conductive;

a housing that holds the antenna element and is adapted to be worn attached to a body appendage; and a RF transceiver operative to synthesize, transmit, receive, and demodulate RF signals of a desired wide-band frequency range:

wherein the communications device is configured for wearing directly attached to or in tactile proximity to a user's body appendage; and wherein the communications device is operative when the user's body appendage and the RF transceiver are both in the nearfield of the device;

wherein the miniature RF communications device is operative at one or more frequency bands utilized in LTE (4G), 5G, Wi-fi, Bluetooth, 2G, 3G, UMTS, or GPS; and wherein the antenna element is disposed on an inside surface of the housing.

4. The communications device of claim 3, wherein the antenna is operative at multiple frequency bands, and wherein at least one of the frequency bands is operating within the 800 MHz-3600 MHz frequency range.

5. The communications device of claim 3, wherein the antenna is operative at multiple frequency bands, and wherein at least one of the frequency bands is operating within the 800 MHz-6000 MHz frequency range.

6. The communications device of claim 3, wherein air is used as a dielectric for the antenna.

* * * * *